US012146257B2

(12) United States Patent
Zielke et al.

(10) Patent No.: US 12,146,257 B2
(45) Date of Patent: Nov. 19, 2024

(54) METHOD FOR OPERATING A WASHING MACHINE, AND WASHING MACHINE

(71) Applicant: Miele & Cie. KG, Gütersloh (DE)

(72) Inventors: Marcel Zielke, Ennigerloh (DE); Magnus Kortenjann, Telgte (DE); Dirk Sieding, Lünen (DE); Rainer Bicker, Verl (DE)

(73) Assignee: MIELE & CIE. KG, Gütersloh (DE)

( * ) Notice: Subject to any disclaimer, the term of this patent is extended or adjusted under 35 U.S.C. 154(b) by 174 days.

(21) Appl. No.: 17/916,207

(22) PCT Filed: Mar. 22, 2021

(86) PCT No.: PCT/EP2021/057269
§ 371 (c)(1),
(2) Date: Sep. 30, 2022

(87) PCT Pub. No.: WO2021/197898
PCT Pub. Date: Oct. 7, 2021

(65) Prior Publication Data

US 2023/0160129 A1 May 25, 2023

(30) Foreign Application Priority Data

Mar. 30, 2020 (DE) ..... 102020108754.3

(51) Int. Cl.

| | |
|---|---|
| ***D06F 23/00*** | (2006.01) |
| ***D06F 33/36*** | (2020.01) |
| ***D06F 35/00*** | (2006.01) |
| ***D06F 37/02*** | (2006.01) |
| ***D06F 37/30*** | (2020.01) |

(Continued)

(52) U.S. Cl.
CPC ..... *D06F 37/38* (2013.01); *D06F 23/00* (2013.01); *D06F 33/36* (2020.02); *D06F 35/006* (2013.01); *D06F 37/02* (2013.01); *D06F 37/304* (2013.01); *D06F 37/34* (2013.01); *D06F 2103/04* (2020.02); *D06F 2103/46* (2020.02); *D06F 2105/00* (2020.02); *D06F 2105/48* (2020.02)

(58) Field of Classification Search
None
See application file for complete search history.

(56) References Cited

U.S. PATENT DOCUMENTS

| | | | | |
|---|---|---|---|---|
| 10,370,787 | B2 | 8/2019 | Bae | |
| 2010/0058814 | A1* | 3/2010 | Kim | D06F 34/28 68/12.23 |

FOREIGN PATENT DOCUMENTS

| | | | |
|---|---|---|---|
| EP | 2113601 | A1 | 11/2009 |
| EP | 3505668 | A1 | 7/2019 |
| WO | 2012020898 | A1 | 2/2012 |

* cited by examiner

*Primary Examiner* — Levon J Shahinian
(74) *Attorney, Agent, or Firm* — Dickinson Wright PLLC

(57) ABSTRACT

A washing machine and method for operating a washing machine having a suds container for holding washing liquid, a non-ribbed drum rotatably mounted in the suds container for holding laundry, a motor for driving the drum, and an open or closed loop control device, wherein the method has a step for rearranging the laundry in the drum. The drum is caused to execute a right-left motion by means of the motor so as to cause a rocking motion of the laundry at a rocking frequency, the predetermined rocking amplitude of which is adjusted such that a laundry fall is implemented in which the laundry falls from a first region of the drum into a second region of the drum.

13 Claims, 2 Drawing Sheets

(51) Int. Cl.

| | |
|---|---|
| ***D06F 37/34*** | (2006.01) |
| ***D06F 37/38*** | (2006.01) |
| *D06F 103/04* | (2020.01) |
| *D06F 103/46* | (2020.01) |
| *D06F 105/00* | (2020.01) |
| *D06F 105/48* | (2020.01) |

METHOD FOR OPERATING A WASHING MACHINE, AND WASHING MACHINE

RELATED APPLICATIONS

The present disclosure claims priority to and the benefit of PCT Application PCT/EP2021/057269, filed on Mar. 22, 2021, which claims priority to and the benefit of German Application 10 2020 108 754.3, filed on Mar. 30, 2020, the entire contents of which are incorporated herein by reference.

TECHNICAL FIELD

The disclosure relates to a method for operating a washing machine and to a washing machine. In particular, the disclosure relates to a method for operating a washing machine having a suds container for holding washing liquid, a drum rotatably mounted in the suds container for holding laundry, a motor for driving the drum, and an open or closed loop control device, wherein the method has a step for rearranging the laundry in the drum, and to a corresponding washing machine.

BACKGROUND

Typically, washing machine drums have ribs inside. A rib, which is also referred to as an entraining element, is a part of the drum which, when the drum is moved, also causes the laundry inside the drum to execute a motion, i.e. it entrains the laundry. The rib is usually an elevation in the drum protruding from the drum casing, pointing in the direction of the centre of the drum, and on which the laundry located in the drum hangs up to a specific height during the drum rotation and then falls down again and in this way is swirled around and rearranged. Usually, there are a plurality of ribs in the drum, which are arranged at predetermined distances from one another. The ribs are substantial for the laundry to be rearranged while executing a washing program. A common washing rhythm during the execution of a washing program consists of an alternation of clockwise drum rotation, pause, anti-clockwise drum rotation, pause, clockwise rotation, pause, etc. However, the ribs are additional components that add cost. Therefore, a non-ribbed drum would be desirable.

SUMMARY

The disclosure provides a method for operating a washing machine and a washing machine having a non-ribbed drum that are inexpensive.

According to the disclosure, this is achieved by a method and by a washing machine having the features of the main claims. Advantageous embodiments and developments of the disclosure can be found in the subsequent sub-claims.

The advantages achievable with the disclosure are, in addition to the cost-effectiveness, that the rocking washing rhythm implemented with the method causes a relatively high washing mechanics and thus allows for relatively fast washing and/or a relatively high washing effect, which can be necessary for relatively heavy soiling. At the same time, the washing rhythm allows the laundry to be rearranged without using engagement ribs, even in the case of a relatively small laundry load.

The disclosure relates to a method for operating a washing machine having a suds container for holding washing liquid, a non-ribbed drum rotatably mounted in the suds container for holding laundry, a motor for driving the drum, and an open or closed loop control device, wherein the method has a step for rearranging the laundry in the drum, in which the drum is caused to execute a right-left motion by means of the motor so as to cause a rocking motion of the laundry at a rocking frequency, the predetermined rocking amplitude of which is adjusted such that a laundry fall is implemented in which the laundry falls from a first region of the drum into a second region of the drum.

In the development of the washing process technology for a washing machine having a non-ribbed drum, it has been discovered that, in particular in the case of a relatively small amount of laundry in the drum, the items of laundry slide when the drum rotates and are not entrained by the drum. The sliding creates a new type of washing mechanics by rubbing on a side of the item of laundry that faces the drum. However, in order to be able to apply a washing mechanics to the sides of the items of laundry that are not directed towards the drum, it is necessary to rearrange the laundry, which is not possible due to the sliding. By means of the method according to the disclosure, the laundry is rearranged in the drum despite the tendency to slide and a washing mechanics that causes the laundry to fall is produced. This provides a washing rhythm with a relatively strong washing mechanics by adjusting the drum in a right-left movement, which results in a rocking motion of the laundry, which is large enough for the laundry to fall. Slight frictional contact between the drum and the laundry is sufficient for this purpose, without the laundry sliding in the drum.

A non-ribbed drum is a drum that does not have a rib or entraining element inside it. However, it can have other elevations and/or depressions that do not have the shape of the plate-shaped rib or entraining element. The drum, preferably the drum casing, preferably has depressions and/or elevations other than a rib. It preferably has honeycombs, each of which is designed as an elevation or a depression.

The first region of the drum is a region that is below the second region of the drum, based on an operational set-up position of the washing machine.

In a preferred embodiment, the rocking frequency is adjusted in the range of from −50% to +20% of a calculated rocking frequency stored in the washing machine, wherein the calculated rocking frequency stored is calculated using the following formula (1)

$$f = \frac{\sqrt{\frac{g}{r}}}{2\pi} \tag{1}$$

where f is the predetermined rocking frequency, g is the gravitational constant (=9.81 m/s2), and r is a drum radius of the non-ribbed drum. The drum radius is an inner radius of the drum. The rocking frequency is preferably adjusted at −30% of the rocking frequency calculated using the formula (1) stored in the washing machine. This also ensures that the laundry is entrained with sufficient certainty and that a relatively intensive laundry fall is caused.

The rocking frequency is preferably adjusted such that the rotational speed has a triangular curve over time. This ensures that the laundry is entrained safely without sliding. The triangular time curve is preferably implemented by accelerating the motor alternately with constant acceleration in portions. Since the curve of the angle of rotation represents the integral of the rotational speed curve, it still runs almost sinusoidally due to the properties of the integration (attenuation of the higher frequency components with −20 dB/decade). An exact sinusoidal curve is not necessary. The triangular time curve of the rotational speed has the advantage that it can be implemented with a relatively low computing power of the open or closed loop control device.

In a preferred embodiment, the predetermined rocking amplitude is more than +/−90°. This will further ensure that laundry fall will not occur. More preferably, the predetermined rocking amplitude is in the range of from +/−90° to +/−150°. Even more preferably, the predetermined rocking amplitude is in the range of from +/−100° to +/−110°. This also ensures that the laundry is entrained with sufficient certainty and that a relatively intensive laundry fall is caused.

In a preferred embodiment, the rocking amplitude is increased from zero to the predetermined rocking amplitude within a predetermined period of time. This has the advantage that the rocking amplitude can be gradually increased until it is so large that the laundry falls.

The predetermined period of time is preferably a first period of time which is up to 0.5 rocking periods, preferably up to 0.2 rocking periods. This causes the laundry to slide at the beginning of the method, giving a brief initial phase of surface friction between the drum and the laundry, which further contributes to the washing effect. Alternatively preferably, the predetermined period of time is a second period of time which is 1.0 to 2.0 rocking periods, more preferably 1.5 rocking periods. This further ensures that the majority of the laundry is still entrained within this second period of time without sliding. In a preferred embodiment, the predetermined period of time depends on a type of laundry, which is determined by adjusting the washing program. This has the advantage that more delicate laundry can be subjected to less friction compared to less delicate laundry, while the less delicate laundry can be subjected to stronger washing mechanics.

In a preferred embodiment, the predetermined rocking amplitude is maintained for a predetermined period of time. If the rocking amplitude is maintained after the predetermined rocking amplitude has been reached, the laundry will constantly rise and fall alternately on the right and left side, based on the operational set-up position of the washing machine. This creates a relatively intensive washing mechanics.

Furthermore, the disclosure relates to a washing machine having a suds container for holding washing liquid, a non-ribbed drum rotatably mounted in the suds container for holding laundry, a motor for driving the drum, and an open or closed loop control device that is designed to carry out a method according to one or more of the embodiments described above.

Embodiments and advantages described for the method apply correspondingly to the washing machine and vice versa.

The washing machine can be a front loader or a top loader. The term "washing machine" also comprises a combination device such as a washer-dryer. The drum is preferably mounted in the suds container so that it can rotate about the horizontal axis of rotation.

The open or closed loop control device can be designed in one or more parts. In addition to regulating the rotational speed of the motor for driving the drum, it has other open or closed loop control means that are required to execute the washing program.

BRIEF DESCRIPTION OF THE DRAWINGS

An embodiment of the disclosure is shown in the drawings in a purely schematic manner and will be described in more detail below. In the drawings.

DETAILED DESCRIPTION OF THE DRAWINGS

Figure 1:
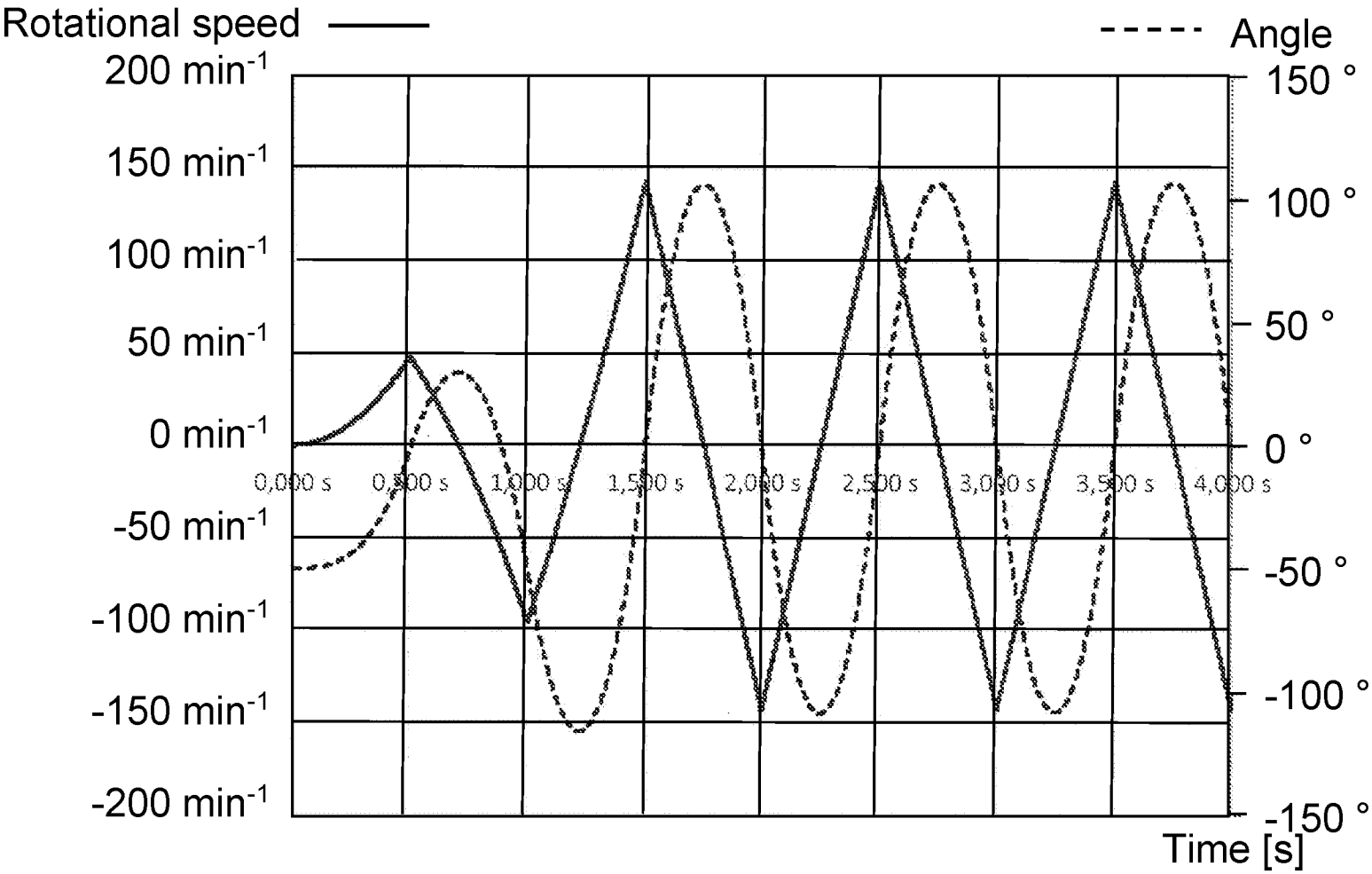
FIG. 1 is a time curve of a rotational speed and an angle in a method according to the disclosure.

FIG. 1 is a time curve of a rotational speed and an angle in a method according to the disclosure. The rotational speed curve over time is triangular. The triangular shape is achieved by alternating acceleration of the motor with constant acceleration in portions. The rotational speed is increased in an acceleration phase until it varies in the range of +/−150 rpm. Since the curve of the angle, i.e., the angle of rotation, represents the integral of the rotational speed curve, it runs almost sinusoidally due to the properties of the integration (attenuation of the higher frequency components −20 dB/decade).

A rocking amplitude predetermined for generating a fall of laundry is initially increased from zero to the predetermined rocking amplitude within a predetermined period of time. The predetermined period of time is a first period of time, which is, for example, 1.5 rocking periods. The first period of time represents the acceleration phase, in which a large part of the laundry is entrained without sliding as the drum rotates. As soon as the predetermined rocking amplitude, for example of approx. +/−100°, is reached, the laundry begins to fall. If the predetermined rocking amplitude is then maintained, the laundry will constantly rise and fall alternately on the right and left side of the drum, based on the operational set-up position of the washing machine.

Figure 2:
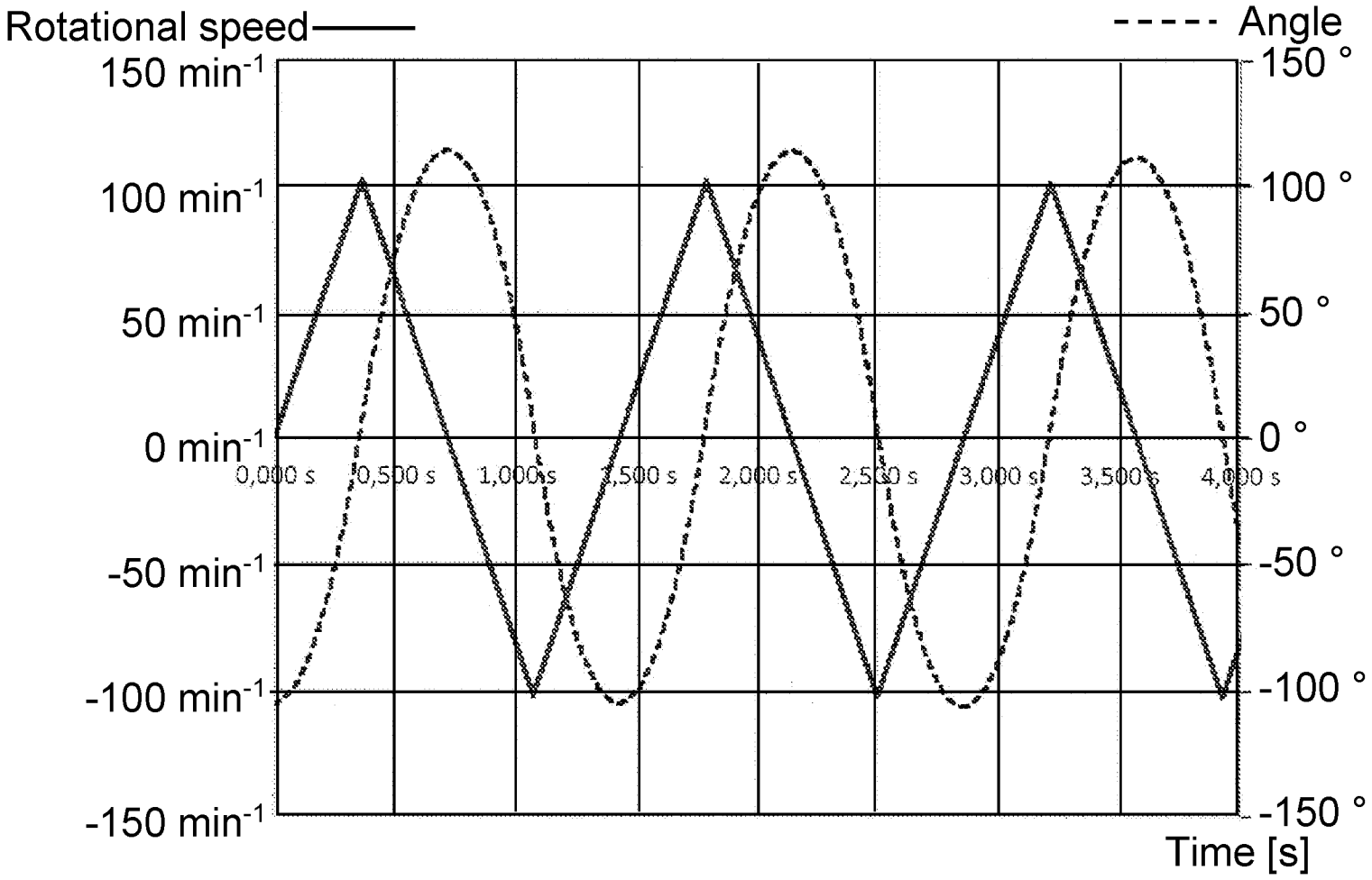
FIG. 2 is a time curve of a rotational speed and an angle in a further method according to the disclosure.

FIG. 2 is a time curve of a rotational speed and an angle in a further method according to the disclosure. The time curves of rotational speed and angle shown in FIG. 2 correspond to the time curves shown in FIG. 1 with the difference that the predetermined period of time is a second period of time which is zero and the rotational speed of the drum is in the range of +/−100 rpm is varied, so that the acceleration phase described in relation to FIG. 1 is missing. In other words, at the beginning of the method, the laundry slides in the drum, so that at the beginning there is a short phase with surface friction between the drum and the laundry.

The invention claimed is:

1. A method for operating a washing machine having a suds container for holding washing liquid, a non-ribbed drum rotatably mounted in the suds container for holding laundry, a motor for driving the drum, and an open or closed loop control device, wherein the method has a step for rearranging the laundry in the drum, in which the drum is caused to execute a right-left motion by means of the motor so as to cause a rocking motion of the laundry at a rocking frequency, the rocking frequency having a predetermined rocking amplitude which is adjusted such that a laundry fall is implemented in which the laundry falls from a first region of the drum into a second region of the drum, and wherein the rocking frequency is adjusted in the range of from −50% to +20% of a calculated rocking frequency stored in the washing machine, wherein the calculated rocking frequency stored is calculated using the following formula (1), $$f = \frac{\sqrt{\frac{g}{r}}}{2\pi} \quad (1)$$

where f is the predetermined rocking frequency, g is the gravitational constant=9.81 m/s$^2$, and r is a drum radius of the non-ribbed drum.

2. The method according to claim 1, wherein the rocking frequency is adjusted such that the rotational speed has a triangular time curve.

3. The method according to claim 2, wherein the triangular time curve is implemented by accelerating the motor alternately with constant acceleration in portions.

4. The method according to claim 1, wherein the predetermined rocking amplitude is more than +/−90°.

5. The method according to claim 1, wherein the rocking amplitude is increased from zero to the predetermined rocking amplitude within a predetermined period of time.

6. The method according to claim 5, wherein the predetermined period of time is a first period of time which is up to 0.5 commuting periods, or a second period of time which is 1.0 to 2.0 rocking periods.

7. The method according to claim 6, wherein first period of time is up to 0.2 rocking periods.

8. The method according to claim 6, wherein the second period of time is 1.5 rocking periods.

9. The method according to claim 1, wherein the predetermined rocking amplitude is maintained over a predetermined period of time.

10. A washing machine having a suds container for holding washing liquid, a non-ribbed drum which is rotatably mounted in the suds container for holding laundry, a motor for driving the drum, and an open or closed loop control device designed to execute the method according to claim 1.

11. The method according to claim 1, wherein the rocking frequency is adjusted to −30% of the calculated rocking frequency stored in the washing machine.

12. The method according to claim 1, wherein the predetermined rocking amplitude is in the range of from +/−90° to +/−150°.

13. The method according to claim 1, wherein the predetermined rocking amplitude is in the range of from +/−100° to +/−110°.

* * * * *